US007306268B2

(12) United States Patent
Tanaka et al.

(10) Patent No.: US 7,306,268 B2
(45) Date of Patent: Dec. 11, 2007

(54) MANUAL RELEASING MECHANISM FOR POWER LOCKING APPARATUS

(75) Inventors: Takeki Tanaka, Wako (JP); Yosuke Kimura, Wako (JP); Kazuya Shibata, Wako (JP); Tomofumi Ichinose, Wako (JP)

(73) Assignee: Honda Motor Co. Ltd., Tokyo (JP)

( * ) Notice: Subject to any disclaimer, the term of this patent is extended or adjusted under 35 U.S.C. 154(b) by 43 days.

(21) Appl. No.: 10/960,217

(22) Filed: Oct. 7, 2004

(65) Prior Publication Data

US 2005/0082844 A1 Apr. 21, 2005

(30) Foreign Application Priority Data

Oct. 16, 2003 (JP) ..... 2003-356525

(51) Int. Cl.
*E05B 3/00* (2006.01)
*E05C 3/06* (2006.01)

(52) U.S. Cl. ..... 292/336.3; 292/92; 292/DIG. 53; 292/DIG. 65

(58) Field of Classification Search ..... 292/336.3, 292/92, DIG. 53, DIG. 54, DIG. 65, 216, 292/215; 403/325
See application file for complete search history.

(56) References Cited

U.S. PATENT DOCUMENTS 3,054,634 A * 9/1962 Westerdale ..... 292/336.3
3,385,620 A * 5/1968 Porvin ..... 292/59
3,832,074 A * 8/1974 Dehar ..... 403/163
3,984,191 A * 10/1976 Doty ..... 403/69
4,283,155 A * 8/1981 Yamazaki et al. ..... 403/163
4,474,492 A * 10/1984 Fleitas ..... 403/322.4
4,762,349 A * 8/1988 Ikeda ..... 292/216
4,875,724 A * 10/1989 Gruber ..... 292/216
5,237,889 A * 8/1993 Conrad ..... 74/502.4
5,445,421 A * 8/1995 Ferrara ..... 292/216
5,967,570 A * 10/1999 Lee ..... 292/31
6,135,514 A * 10/2000 Kowalewski et al. ..... 292/216
6,247,732 B1 * 6/2001 Alton ..... 292/216
6,369,395 B1 * 4/2002 Roessler ..... 250/462.1
6,394,511 B1 * 5/2002 Lam et al. ..... 292/336.3
6,467,320 B1 * 10/2002 Choo ..... 70/256
6,474,190 B1 * 11/2002 Choo ..... 74/502.4
6,805,386 B2 * 10/2004 Ehret et al. ..... 292/216

FOREIGN PATENT DOCUMENTS

| | | | |
|---|---|---|---|
| DE | 3839464 | * | 5/1990 |
| JP | 5-39167 | | 10/1993 |
| JP | H08218710 | * | 8/1996 |
| JP | 2000-179210 | | 6/2000 |
| JP | 2002220958 | * | 8/2002 |
| JP | 2002-303064 | | 10/2002 |
| JP | 2005076229 | * | 3/2005 |

* cited by examiner

*Primary Examiner*—Carlos Lugo
(74) *Attorney, Agent, or Firm*—Rankin, Hill, Porter & Clark LLP

(57) ABSTRACT

A manual releasing mechanism for a power locking apparatus including a detachable hook-shaped portion 26 for holding a locked state and a flexible belt 17, wherein the hook-shaped portion is locked to a releasing lever 11 of the door locking apparatus 4, whereby the door locking apparatus 4 is released by pulling the belt.

11 Claims, 6 Drawing Sheets

MANUAL RELEASING MECHANISM FOR POWER LOCKING APPARATUS

BACKGROUND OF THE INVENTION

The present invention relates to a manual releasing mechanism for a power locking apparatus.

Among vehicles such as automobiles, there are ones having a power tailgate which is operated electrically to open and close an opening at the rear of a vehicle body. Since a power locking apparatus of such a tail gate is constructed such that a releasing lever of the locking apparatus is normally released using a motor, in a case where electric systems are not assembled on an assembly line in an assembly plant, in the event that the tailgate is locked by the locking apparatus in a closed state, a worker needs to get into the vehicle body from a front side thereof to manually operate the releasing lever. Work like this constitutes a load to the worker and serves to make the tact time longer. To deal with this, there has existed a conventional solution in which a cord is passed through the releasing lever of the locking apparatus, a knot is tied in the cord and the cord is drawn to the outside of the vehicle body through a gap between the tailgate and the vehicle body in a state in which the knot is locked to the releasing lever, so that the worker can pull the cord when the releasing lever needs to be operated to open and close the tailgate.

[Patent Document]

JP-A-2000-179210

In the conventional technique, however, since the cord needs to be passed through the locking apparatus of every vehicle in advance, there are problems that the production cost of the locking apparatus is increased and that there is caused a risk that the cord comes off the locking apparatus when the system is handled.

SUMMARY OF THE INVENTION

Then, the invention is made with a view to solving the problems and an object thereof is to provide a manual releasing mechanism for a power locking apparatus which does not need to be mounted on every power locking apparatus in advance, which is easy to operate and which can ensure the mounting on a power locking mechanism.

With a view to solving the problems, according to a first aspect of the invention, there is provided a manual releasing mechanism for a power locking apparatus including a detachable locking member (for example, locking tools 16, 34 in embodiments) for holding a locked state and a flexible operated member (for example, belts 17, 35 in the embodiments) mounted on the locking member, wherein the locking member is locked to a releasing lever (for example, releasing levers 11, 39 in the embodiments) of the locking apparatus (for example, a door locking apparatus in the embodiments), whereby the locking apparatus is released by pulling the operated member.

According to the construction, the operated member can be mounted when the worker thinks it necessary, and hence the operated member can be used repeatedly as needed.

According to a second aspect of the invention, there is provided a manual releasing mechanism for a power locking apparatus as set forth in the first aspect of the invention, wherein the locking member has a locking plate on which the operated member is mounted and which is brought into abutment with the releasing lever, whereby the locking plate rotates the releasing lever when the operated member is pulled.

According to the construction, an input from the operated member can be transmitted efficiently to the releasing lever via the locking plate.

According to a third aspect of the invention, there is provided a manual releasing mechanism for a power locking apparatus as set forth in the first or second aspect of the invention, wherein the operated member is a belt-like member.

According to the construction, the operated member can be easily passed through the outside or inside of the closing body having the power locking apparatus, and an operation force can be transmitted to the releasing lever in an ensured fashion.

According to a fourth aspect of the invention, there is provided a manual releasing mechanism for a power locking apparatus as set forth in any of the first to third aspects of the invention, wherein the locking member has a hook-shaped portion.

According to the construction, a locked state between the releasing lever and the locking member can be ensured.

According to a fifth aspect of the invention, there is provided a manual releasing mechanism for a power locking apparatus as set forth in the fourth aspect of the invention, wherein the hook-shaped portion of the locking member has an elasticity for holding a locked state of the releasing lever.

According to the construction, locking and unlocking of the locking member to and from the releasing lever can be effected in a one-touch fashion.

According to the first aspect of the invention, since the operated member can be mounted when the worker thinks it necessary and hence the operated member can be used repeatedly as needed, there is provided an advantage that costs can be attempted to be reduced.

According to the second aspect of the invention, since an input from the operated member can be transmitted efficiently to the releasing lever via the locking plate, in addition to the advantage provided by the first aspect of the invention, there is provided an advantage that the cancellation of locking of the closing body can be ensured with less force.

According to the third aspect of the invention, since the operated member can be easily passed through the outside or inside of the closing body having the power locking apparatus and an operation force can be transmitted to the releasing lever in an ensured fashion, in addition to the advantage provided by the first or second aspect of the invention, there is provided an advantage that the operation of the operated member from the outside can be improved.

According to the fourth aspect of the invention, since a locked state between the releasing lever and the locking member can be ensured, in addition to the advantage provided by any of the first to third aspects of the invention, there is provided an advantage that the working efficiency can be improved.

According to the fifth aspect of the invention, since locking and unlocking of the locking member to and from the releasing lever can be effected in a one-touch fashion, in addition to the advantage provided by the fourth aspect of the invention, there is provided an advantage that the working time can be reduced.

DETAILED DESCRIPTION OF THE PREFERRED EMBODIMENTS

First Embodiment

A first embodiment of the invention will be described below by reference to the drawings.

Figure 1:
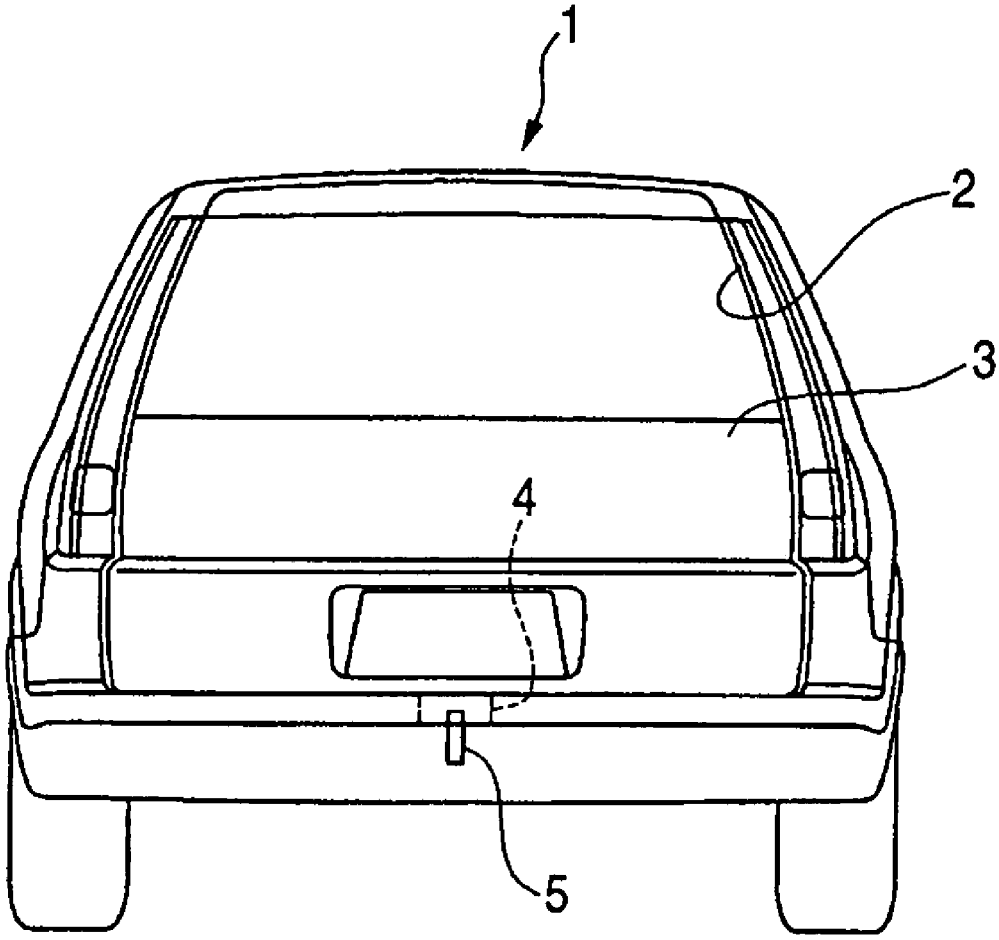
FIG. 1 is a back side view of a vehicle according to a first embodiment of the invention.

As shown in FIG. 1, a tailgate 3 is supported to freely open and close a rear opening 2 of a vehicle body 1. A door locking apparatus 4 (a locking apparatus) is provided at a central portion of a lower side of the tailgate 3, and a striker 5 is provided at a central portion of a lower side of the rear opening 2 of the vehicle body 1 so as to correspond to the door locking apparatus 4, whereby the tailgate 3 is locked in such a manner as to be freely opened and closed.

Figure 2:
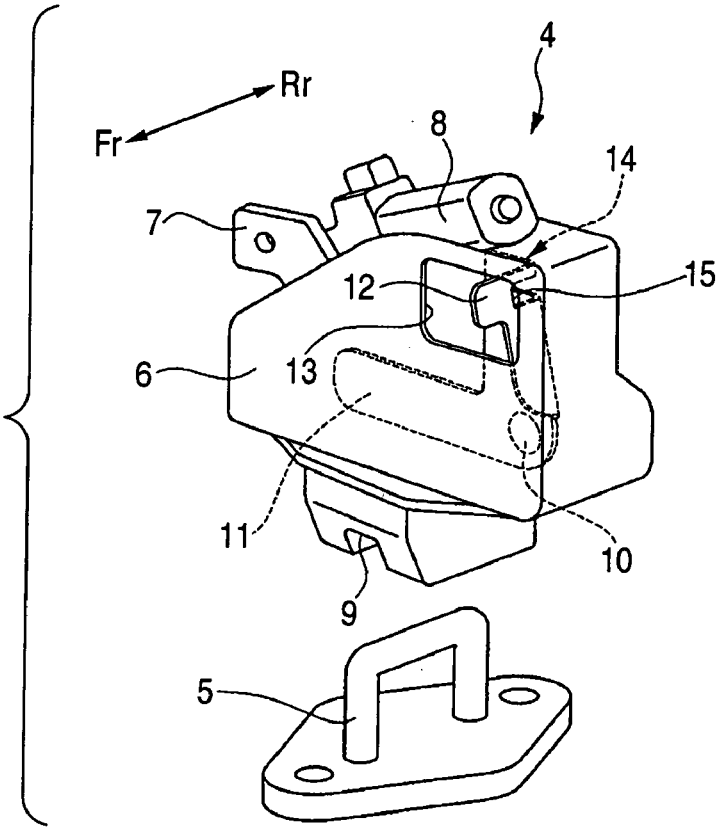
FIG. 2 is a perspective view of an electric locking apparatus according to the first embodiment of the invention.

As shown in FIG. 2, the door locking apparatus 4 has a casing 6, and a mounting bracket 7 and a driving motor 8 are provided on a top portion of the casing 6. The door locking apparatus 4 is fixed to a bottom portion of the tailgate 3 by the mounting bracket 7. The driving motor 8 is such as to latch and unlatch the striker 5 that is accommodated in a recessed portion 9 provided in a bottom portion of the casing 6 via a driving mechanism, not shown, which is provided within the casing 6, and in the first embodiment, the tailgate 3 is opened and closed electrically in a state in which the door locking apparatus 4 is unfastened from the striker 5. Note that a second embodiment, which will be described later on, has the same door locking apparatus driving mechanism.

A releasing lever 11 (a releasing lever) is provided within the casing 6 in such a manner as to freely rotate about a hinge pin 10. This releasing lever 11 is formed substantially into an L-shape, and a locking piece 12 is provided at an upper end thereof in such a manner as to protrude into a passenger compartment side. Then, an opening 13 is provided in a side wall of the casing 6 in such a manner as to correspond to the locking piece 12. The releasing lever 11 is such as to release the door locking apparatus 4 from a locked state to the striker 5 by manually operating the driving mechanism, not shown, which is provided within the casing 6, and to be specific, the releasing lever 11 is rotated in a transverse direction of the vehicle when the worker operates the locking piece 12 in a direction indicated by an arrow in FIG. 2 from the opening 13, whereby the engagement of the door locking apparatus 4 with the striker 5 is released.

Consequently, in assembly lines of vehicle bodies 1, when various assembling operations are carried out with a tailgate 3 mounted, a worker is normally required to get into a vehicle which is being assembled to operate the releasing lever 11 from the inside of the passenger compartment of the vehicle so as to open the tailgate 3 which is in a closed state every time the tailgate 3 needs to be opened, so that needed work is done.

Figure 3:
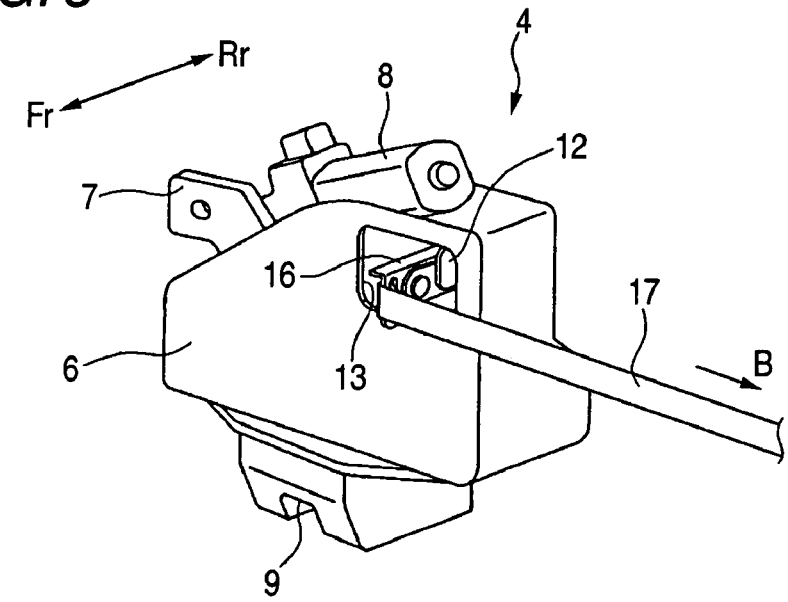
FIG. 3 is a perspective view showing a state in which a manual releasing device according to the first embodiment of the invention is mounted in place.
Figure 4:
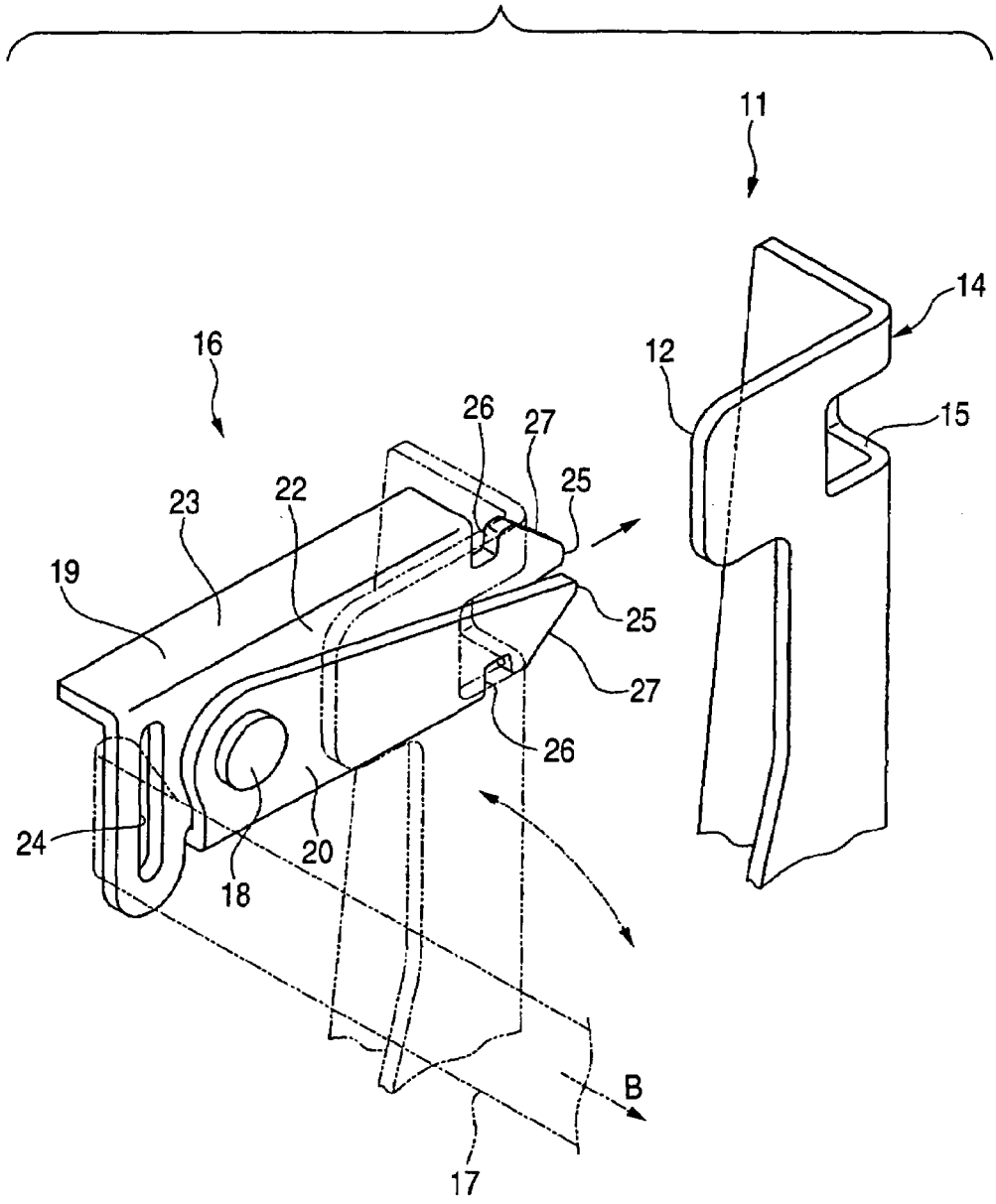
FIG. 4 is a perspective view showing the releasing device and a releasing lever according to the first embodiment of the invention.

As shown in FIG. 4, an engagement hole 15 is provided in a proximal portion 14 of the locking piece 12 of the releasing lever 11. A locking tool 16 (a locking member) is mounted in the engagement hole 15, and when a belt 17 (an operated member) attached to the locking tool 16 is pulled in a direction indicated by an arrow B as shown in FIG. 3, the leasing lever 11 is operated, whereby the door locking apparatus 4 is released, thereby allowing the tailgate 3 to be opened in a rearward direction Rr and closed in a forward direction Fr.

Figure 5:
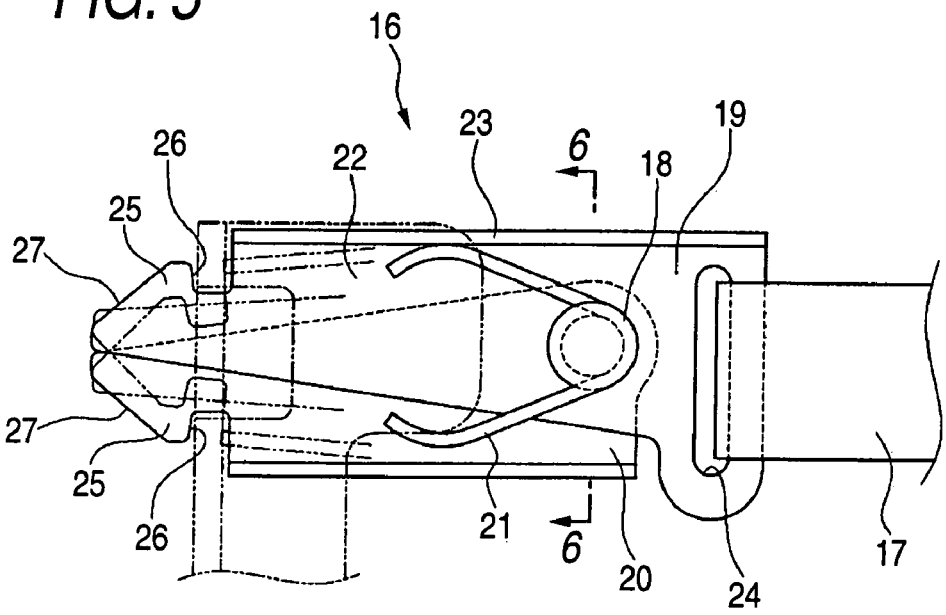
FIG. 5 is a plan view of the first embodiment of the invention.
Figure 6:
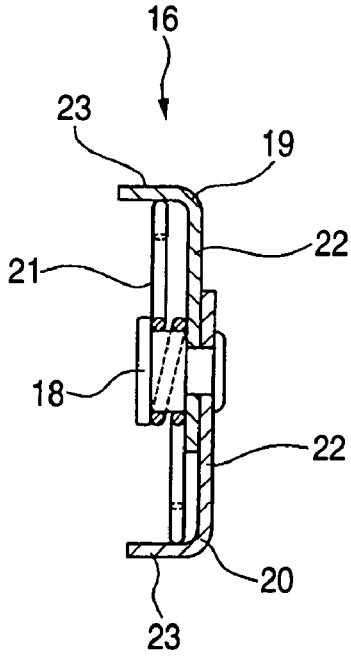
FIG. 6 is a cross-sectional view taken along the line A-A in FIG. 5.

As shown in FIG. 5, the locking tool 16 is such that a pair of a first locking plate 19 and a second locking plate 20, which are supported by a pin 18 at proximal ends thereof, are biased in an opening direction with a torsion spring 21. These first locking plate 19 (a locking plate) and the second locking plate 20 are metallic members formed by pressing, as shown in FIG. 6, and each of the plates has a base portion 22 and an erect portion 23. The first and second plates 19, 20 are connected to each other by the pin 18 and are biased in the opening direction by the torsion spring 21 wound around the pin 18. A through hole 24 is provided in the first locking plate 19 at a proximal end thereof so that the belt 17 is passed therethrough, and a substantially triangular locking projection 25 is provided on the first locking plate 19 at a distal end thereof.

This locking projection 25 has a hook-shaped portion 26 (a hook-shaped portion) which is constricted inwardly, and the hook-shaped portion 26 is designed to be locked on upper and lower edges of the engagement hole 15 in the releasing lever 11. In addition, a proximal end of the second locking plate 20 is formed into an arc-like shape which follows the pin 18, and a locking projection 25, which is similar to that on the first locking plate 19, is also provided on the second locking plate 20 at a distal end thereof. In addition, a hook-shaped portion 26, which is similar to that on the first locking plate, is also formed on the locking projection 25. Then, these locking projections 25, 25 are set such that when the locking projections 25, 25 are biased by virtue of the biasing force of the torsion spring 21 in a direction in which the projections are separated apart from each other, the locking projections 25, 25 are locked in the engagement hole 15, whereas when the locking projections 25, 25 are pressed to be contracted in a direction in which the first locking plate 19 and the second locking plate 20 are made to approach each other against the biasing force of the torsion spring 21, outer edges of the first and second locking plates 19, 20 become smaller than the height-wise dimension of the locking hole 15 in the releasing lever 11 as indicated by double-dashed lines in FIG. 5.

Here, each of the locking projections 25, 25 has inclined surfaces 27, 27 which approach each other as they extend outwardly to a distal end of the projection, and when the locking tool 16 is pushed into the engagement hole 15 in the releasing lever 11, the locking projections 25, 25 are naturally passed through the engagement hole 15, whereby the hook-shaped portions 26, 26 are expanded by virtue of the biasing force of the torsion spring 21 so as to be locked in the engagement hole 15 in a one-touch fashion.

Note that the strength and rigidity of the first locking plate 19 and the second locking plate 20 are secured by the aforesaid erect portions 23 thereof, so that, as will be described later on, sufficient strength and rigidity can be secured when the worker pulls the belt 17.

According to the first embodiment, the locking tool 16 is mounted sequentially on vehicles that are carried to the assembly line of vehicle bodies 1. In this state, the belt 17 attached to the first locking plate 19 is left in a state in which the belt 17 extends to the outside of a vehicle through a gap between the rear opening 2 in the vehicle body 1 and the tailgate 3.

Thus, in the event that a needed component is assembled to the interior of the passenger compartment of the vehicle on which the door locking apparatus 4 is already mounted, the releasing lever 11 rotates in a releasing direction when the belt 17 is pulled, whereby the door locking apparatus 4 is put in an unlatched state, so that the worker can manually open the tailgate 3 so as to perform a needed operation in the interior of the passenger compartment.

Then, with the needed operation completed, just before the vehicle, which is being assembled, is transferred to the assembly line where no work needs to be carried out in the interior of the passenger compartment, when the worker compresses the first locking plate 19 and the second locking plate 20 of the locking tool 16 so as to release the locked state and then pulls the locking plates, the locking projections 25, 25 are simply released from the engagement hole 15, and consequently, the removing work of the locking tool 16 can be performed in a one-touch fashion. Then, the locking tool 16 so removed is similarly mounted on a releasing lever 11 of a door locking apparatus 4 of a vehicle that is carried to the relevant part of the assembly line for reuse.

Consequently, since the assembly worker can mount a needed number of locking tools 16 at a needed timing, costs associated with the door locking apparatus 4 can be reduced largely when compared with the conventional case where a cord is attached to every vehicle. In addition, since the attaching and detaching work of the locking tool 16 can be performed in the one-touch fashion, the work can be completed within a short period of time, whereby the number of man-hours involved in production can be reduced largely when compared with the conventional case where the cord is passed through the door locking apparatus on every vehicle.

In addition, as is described before, since only a required number of locking tools 16 may produced, the production costs can be reduced largely in this respect.

Furthermore, since the locking plate 20 (19) is rotated on the principle of lever by pulling the belt 17, the locking piece 12 of the releasing lever can be rotated securely with less operating force.

Then, since the locking tool 16 is mounted in the releasing lever 11 so as to be supported by the locking piece 12 functioning as a supporting portion in such a manner that the through hole 24 through which the belt 17 is passed projects toward the inside of the passenger compartment from the opening 13 in the casing 6, friction or the like which is generated when the belt 17 interferes with the casing 6 or the like is reduced, when the worker pulls the belt 17, and therefore, the operation force of the releasing lever 11 borne by the worker is reduced, thereby making it possible to reduce the load borne by the worker.

In addition, since the belt 17 used needs to be thin when considering the environment where it is used, there are provided the following advantages: a risk is reduced that the belt is caught while being pulled when compared with a case where something like a cord is used, furthermore, a risk is reduced that the vehicle body is damaged, and moreover, the releasing operation can be implemented with less operation force.

Then, since the hook-shaped portions 26, 26 are provided on the aforesaid locking projections 25, 25, the locked state relative to the engagement hole 15 in the releasing lever 11 is ensured, and hence there is no risk that the locking tool 16 is caused to come off in the midst of carrying out the needed operation, this improving the reliability.

Note that since the locking force exerted while the locked state is maintained can be set freely by means of the torsion spring 21, the degree of freedom in design can be increased, and the locked state can be ensured further by setting an appropriate elastic force by virtue of the elastic force of the torsion spring 21.

Second Embodiment

Figure 7:
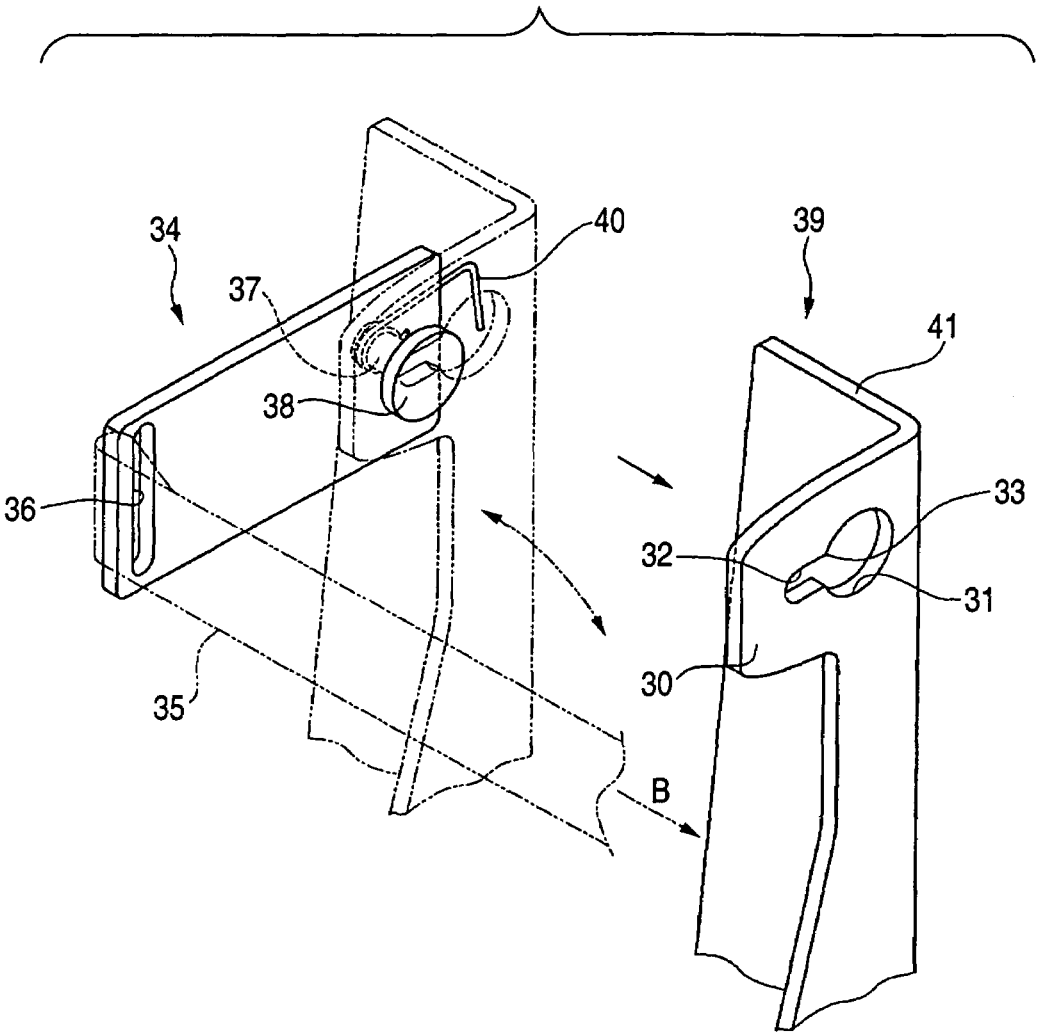
FIG. 7 is a perspective view of a second embodiment of the invention, which corresponds to FIG. 2.
Figure 8:
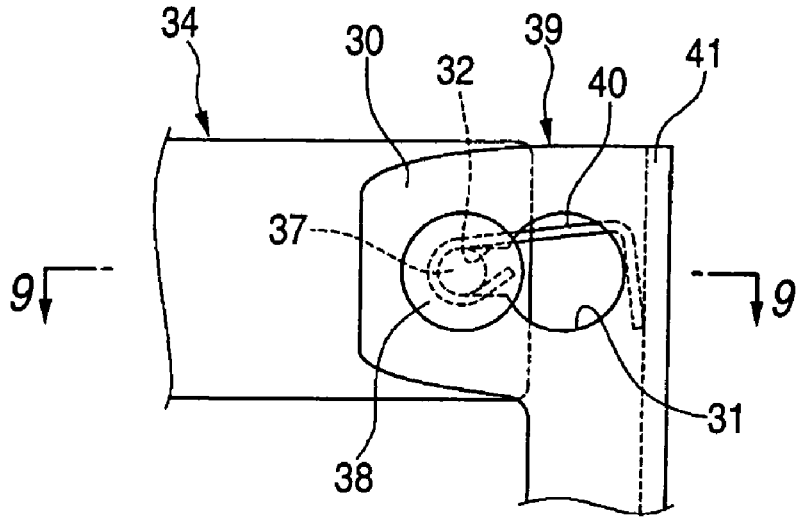
FIG. 8 is a perspective view of the second embodiment of the invention, which corresponds to FIG. 3.

Next, a second embodiment of the invention will be described by reference to FIGS. 7 to 9.

The second embodiment is different from the first embodiment in that a locking tool and an engagement hole on a releasing lever side according to the second embodiment are different from those of the first embodiment.

Note that while, in the first embodiment, since the locking plate is constituted by the first locking plate 19 and the second locking plate 20, these locking plates are made to get together to constitute the locking tool 16, in the second embodiment, a locking tool 34 corresponds to the locking plates of the first embodiment.

While, in the aforesaid first embodiment, the engagement hole 15 is provided at an upper end of the releasing lever 11, in the second embodiment, a tumbler-shaped locking hole 33, which is so shaped by being provided with a large-diameter portion 31 at a proximal end thereof and a small-diameter portion 32 at a distal end thereof, is formed in a locking piece 30 of a releasing lever 39 (a releasing lever). On the other hand, a detachable locking tool 34 (a locking member), which maintains its locked state in the engagement hole 33, has in a proximal end thereof a through hole 36 through which a belt 35 (an operated member), which is similar to that of the first embodiment, is passed, and a locking plate 38 is mounted on a distal end thereof via pin 37. The locking plate 38 is made to be smaller in diameter than the large-diameter portion 31 in the locking piece 30, and the pin 37 which supports the locking plate is made to be smaller in diameter than the small-diameter portion 32 in the locking piece 30.

Note that the pin 37 is made to have a diameter which allows the pin 37 to maintain a locked state while being allowed to fin appropriately in the small-diameter portion 32.

Consequently, when the locking tool 34 is mounted in the engagement hole 33 in the locking piece 30 via this pin 37, in a state in which the locking plate 38 provided on a distal end of the locking tool 34 is first passed through the large-diameter portion 31 in the locking piece 30, the locking tool 34 is pulled toward the operator so that the pin 37 on the locking tool 34 fits in the small-diameter portion 32 in the locking piece 30, whereby the locking tool 34 is mounted in place as required. Here, as shown in FIG. 9, a spring 40 is mounted on an end portion of the pin 37 which is opposite to the end portion thereof where the locking plate 38 is provided for biasing the locking tool 34 in a direction in which the locking tool 34 is separated apart from the releasing lever 39 with the pin 37 being positioned in the small-diameter portion 32 in the locking piece 30. As shown in FIG. 8, the spring 40 is such as to be formed substantially into an L-shape, and a bent portion at a distal end thereof is designed to be brought into an elastic abutment with a vertical wall 41 of the releasing lever 39 so as to maintain the locked state of the locking tool 34 relative to the locking piece 30.

Figure 9:
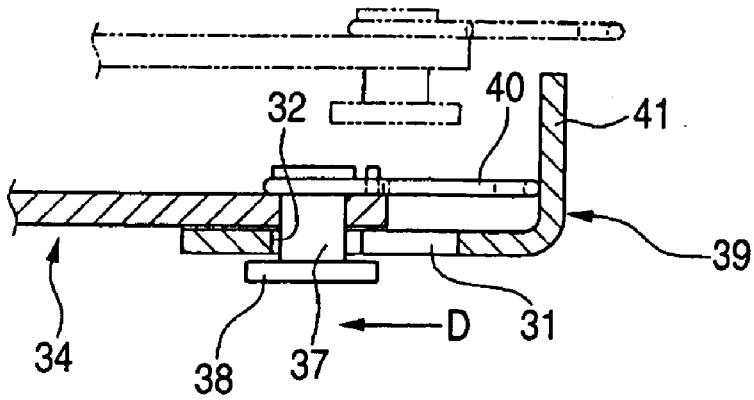
FIG. 9 is a cross-sectional taken along the line C-C in FIG. 8.

Consequently, as shown in FIG. 9, in order to mount the locking tool 34 in the engagement hole 33 in the locking piece 30, firstly, in a state in which the spring 40 is pressed against the vertical wall 41 of the releasing lever 39 with the bent portion thereof being in abutment therewith, the locking plate 38 on the locking tool 34 is passed through the large-diameter portion 31 in the locking piece 30, and when the hand is removed in that state, the pin 37 on the locking tool 34 is pushed in a direction indicated by an arrow D in FIG. 9 by virtue of the elastic force of the spring 40 in the one-touch fashion, whereby the pin 37 is automatically put in a state in which the pin 37 is locked in the small-diameter portion 32.

Consequently, also in the second embodiment, as with the first embodiment that is described before, since a required number of locking tools 34 can be mounted at a required timing by the assembly worker, the costs associated with the door locking apparatus 4 can be reduced largely when compared with the conventional case. In addition, since this mounting and dismounting work can be performed in the one-touch fashion, the required work can be completed within a short period of time.

Then, since the locking tool 34 is mounted in the releasing lever 39 so as to be supported by the locking piece 30 functioning as a supporting portion in such a manner that the through hole 36 through which the belt 35 is passed projects toward the inside of the passenger compartment from the opening 13 in the casing 6, whereby friction or the like which is generated when the belt 35 interferes with the casing 6 or the like is reduced, when the worker pulls the belt 35, the operation force of the releasing lever 39 borne by the worker is reduced, thereby making it possible to reduce the load borne by the worker.

In addition, since the belt 35 used needs to be thin when considering the environment where it is used, there is provided an advantage that the releasing operation can be performed with a small operation force without a risk that the vehicle body is damaged.

Then, since the spring 40 is formed substantially into the L-shape, the locked state of the locking tool 34 relative to the engagement hole 33 in the locking piece 30 is ensured, and hence there is no risk that the locking tool 34 is caused to come off in the midst of carrying out the needed operation, this improving the reliability.

In particular, in contrast to the first embodiment which is constructed to use the two locking plates 19, 20 are used, in the second embodiment, since the simple construction is adopted, there are provided advantages that the occurrence of failure is reduced and that the locking apparatus 4 can be produced at low costs.

Note that while, in this second embodiment, a bending force acts on the locking tool 34 about the pin relative to the locking piece 30, since a force like this is held by the L-shaped spring 40 to thereby restrict the rotation of the locking tool 34, there is caused no problem with actual work.

Note that the invention is not limited to the respective embodiments, and while, for example, the engagement hole 15, 33 is provided in the releasing lever 11, 39, and the locking projections 25 or the locking plate 38 is provided on the locking tool 16 or 34, the locking projections 25 or the locking plate 38 may be provided on the releasing lever 11 or 39, and the engagement hole 15, 33 may be provided in the looking tool 16, 34.

What is claimed is:

1. A manual releasing mechanism on a power locking apparatus comprising:

a releasing lever, said releasing lever being provided by the power locking apparatus and including a locking piece, said locking piece having a length direction and a proximal portion, said proximal portion having an engagement hole formed therein;

a detachable locking member having a distal end and a proximal end, said locking member having a length direction extending between said distal end and said proximal end, said locking member length direction being generally parallel to said locking piece length direction, said distal end including a hook-shaped portion and being received by said engagement hole in said locking piece proximal portion, and a flexible operated member mounted on the locking member proximal end, wherein the locking member distal end is releasably locked to the proximal portion of the locking piece, and the locking apparatus is released by pulling the operated member, wherein the locking member includes a locking plate on which the operated member is mounted and which abuts the proximal portion of the locking piece, and the locking plate rotates the releasing lever when the operated member is pulled.

2. The manual releasing mechanism on a power locking apparatus as set forth in claim 1, wherein the operated member is a belt-like member.

3. The manual releasing mechanism on a power locking apparatus as set forth in claim 2, wherein the belt-like member is pulled in a direction transverse to the length directions of the locking piece and the locking member to release the locking apparatus.

4. The manual releasing mechanism on a power locking apparatus as set forth in claim 1, wherein the hook-shaped portion of the locking member extends through the engagement hole in the locking piece proximal portion and is biased into engagement with the locking piece proximal portion for holding the locking member in a locked state with the releasing lever.

5. A manual releasing mechanism on a power locking apparatus comprising:

a releasing lever, said releasing lever being provided by the power locking apparatus and including a proximal portion, said proximal portion having an engagement hole formed therein;

a detachable locking member having a distal end and a proximal end, said distal end including a hook-shaped portion that is detachably received by said engagement hole in said releasing lever proximal portion, and a flexible operated member mounted on the locking member proximal end, wherein the locking member distal end is releasably locked to the proximal portion of the releasing lever, and the locking apparatus is released by pulling the operated member wherein, the hook-shaped portion of the locking member extends through the engagement hole in the releasing lever proximal portion and is biased into engagement with the releasing lever proximal portion for holding the locking member in a locked state with the releasing lever.

6. The manual releasing mechanism on a power locking apparatus as set forth in claim 5, wherein the operated member is a belt-like member.

7. The manual releasing mechanism on a power locking apparatus as set forth in claim 6, wherein said locking member has a length direction, and wherein the belt-like member is pulled in a direction transverse of the length direction to release the locking apparatus.

8. A manual releasing mechanism on a power locking apparatus comprising:

a releasing lever, said releasing lever being provided by the power locking apparatus and including a proximal portion, said proximal portion having an engagement hole formed therein;

a detachable locking member having a distal end and a proximal end, said distal end being received by said engagement hole in said releasing lever proximal portion, and a flexible operated member mounted on the locking member proximal end, wherein the locking member includes first and second locking plates that are pivotally connected to one another adjacent a proximal end thereof, and wherein a distal end of each of the first and second locking plates include locking projections that extend through the engagement hole in the proximal portion of the releasing lever to releasably lock the distal ends of the locking plates to the proximal portion of the releasing lever, and the locking apparatus is released by pulling the operated member.

9. The manual releasing mechanism on a power locking apparatus as set forth in claim 8, further comprising a biasing spring that is mounted adjacent the proximal end of the locking member and serves to bias the distal ends of the first and second locking plates away from one another, and thereby retains the locking projections in engagement with the releasing lever adjacent the engagement hole.

10. The manual releasing mechanism on a power locking apparatus as set forth in claim 8, wherein the operated member is a belt-like member.

11. The manual releasing mechanism on a power locking apparatus as set forth in claim 10, wherein said locking member has a length direction, and wherein the belt-like member is pulled in a direction transverse of the length direction to release the locking apparatus.

* * * * *